US008690151B2

(12) United States Patent
Gysin et al.

(10) Patent No.: US 8,690,151 B2
(45) Date of Patent: Apr. 8, 2014

(54) METHOD AND APPARATUS FOR SEPARATING OUT PRINTED PRODUCTS FROM A STACK

(75) Inventors: Christoph Gysin, Ormalingen (CH); Pascal Mueller, Newport News, VA (US); Andreas Hess, Strengelbach (CH)

(73) Assignee: Muller Martini Holding AG, Hergiswil (CH)

( * ) Notice: Subject to any disclaimer, the term of this patent is extended or adjusted under 35 U.S.C. 154(b) by 523 days.

(21) Appl. No.: 12/970,300

(22) Filed: Dec. 16, 2010

(65) Prior Publication Data

US 2011/0150621 A1 Jun. 23, 2011

(30) Foreign Application Priority Data

Dec. 18, 2009 (EP) ..... 09180015

(51) Int. Cl.
*B65H 3/06* (2006.01)
*B65H 3/56* (2006.01)

(52) U.S. Cl.
USPC ..... 271/138; 271/124; 271/167; 414/797.8

(58) Field of Classification Search
USPC ..... 221/244, 259, 277; 271/10.03, 131, 271/132, 137, 138, 139, 261, 264, 265.01, 271/270, 135; 414/790.3, 796.5, 796.6, 414/796.8, 797, 797.3, 797.4, 797.6, 797.7, 414/797.8, 797.9, 798.1; 451/334; 74/25, 74/28, 47, 49, 50, 89.32
See application file for complete search history.

(56) References Cited

U.S. PATENT DOCUMENTS

| | | | | |
|---|---|---|---|---|
| 3,377,063 | A * | 4/1968 | Kirby | 271/14 |
| 3,705,719 | A * | 12/1972 | Polit et al. | 271/3.03 |
| 4,077,620 | A * | 3/1978 | Frank et al. | 271/10.03 |
| 4,527,793 | A * | 7/1985 | Bottcher et al. | 271/263 |
| 4,657,236 | A * | 4/1987 | Hirakawa et al. | 271/99 |
| 4,718,808 | A * | 1/1988 | Hoshino et al. | 414/788.8 |
| 5,050,852 | A * | 9/1991 | Sawada et al. | 271/11 |
| 5,145,161 | A * | 9/1992 | Bowser et al. | 271/12 |
| 5,295,677 | A * | 3/1994 | Hutner | 271/110 |
| 5,330,171 | A * | 7/1994 | Murad et al. | 271/131 |
| 5,464,203 | A * | 11/1995 | Bowser et al. | 271/12 |
| 5,678,663 | A * | 10/1997 | Watanabe et al. | 188/67 |
| 5,711,518 | A * | 1/1998 | Portaro et al. | 271/10.03 |
| 5,857,588 | A * | 1/1999 | Kasper | 221/274 |
| 5,888,047 | A * | 3/1999 | Auerbach et al. | 414/797.8 |
| 6,758,470 | B1 * | 7/2004 | Meier et al. | 271/124 |

FOREIGN PATENT DOCUMENTS

DE 1247266 B 8/1967

(Continued)

OTHER PUBLICATIONS

European Search Report issue in European Application No. 09180015.1-1256, Jun. 17, 2010.

*Primary Examiner* — Gregory Adams
(74) *Attorney, Agent, or Firm* — Venable LLP; Robert Kinberg; Frank B. Riggs

(57) ABSTRACT

An apparatus to separate out printed products from a stack including a pushing device to separate out a respective printed product from the stack. The pushing device includes a first rotary drive. The apparatus further includes a downstream-arranged removal device to convey away the respective separated out printed product. The removal device also includes a second rotary drive separate from the first rotary drive.

28 Claims, 9 Drawing Sheets

(56) References Cited

FOREIGN PATENT DOCUMENTS

| | | | |
|---|---|---|---|
| DE | 9208033 | U1 | 8/1992 |
| DE | 19756374 | A1 | 6/1999 |
| DE | 10223350 | A1 | 12/2003 |
| EP | 0035428 | A1 | 9/1981 |
| EP | 0133560 | A2 | 2/1985 |
| EP | 0384979 | B1 | 9/1990 |
| EP | 0414157 | A2 | 2/1991 |
| FR | 2395213 | A1 | 1/1979 |
| GB | 1218004 | A | 1/1972 |

* cited by examiner

METHOD AND APPARATUS FOR SEPARATING OUT PRINTED PRODUCTS FROM A STACK

CROSS-REFERENCE TO RELATED APPLICATION

This application claims the priority of European Patent Application No. 09180015.1, filed on Dec. 18, 2009, the subject matter of which is incorporated herein by reference.

BACKGROUND

The subject matter of the application relates to a method and an apparatus for separating out printed products from a stack. The apparatus includes a pushing device for separating out the printed products and a downstream-arranged removal device for conveying away the separated out printed products.

For separating out printed products from a hopper, in particular perfect-bound printed products having a thickness starting at approximately 2 mm, so-called pusher-feeders are frequently used which comprise a pushing device and a downstream-installed removal device. With this type of technology, the separation capacity is limited owing to the relatively large mass which must be moved with a corresponding stroke of the pushing device. The speed jump experienced by the printed products during the transfer from the pushing device to the removal device, however, leaves unsightly markings on these printed products.

German patent document DE 1247266 provides an apparatus to convey away books and booklets from a filler hopper with the aid of a translational back and forth moving pusher. The pushing device, which makes contact in a form-fitting manner with the back side of the lowest book, comprises stopped conveying belts on the top, wherein this is intended to prevent smudging of the printed surface of the second-lowest book during the movement. The pushing device is moved with the aid of a rotating crank disk and, in the process, carries out an unchangeable sequence of movements. The accelerations which occur during the pushing of a printed product therefore cannot be optimized, which results in a disadvantage for separating apparatuses with a high rate of production.

The German patent document DE 9208033U1 discloses a device which is also provided with a back and forth moving feed element for separating out blanks made of cardboard, corrugated cardboard or the like. In the process, the feed element initially grips the lowest blank in a form-fitting manner, with the aid of transporters attached thereto, wherein following the lifting up of the feed element and thus also the transporters, the second to the lowest blank is also moved along with the aid of suction openings formed into the top of the transporters. While the third to the lowest blank rests against a rear end stop, the movement of the second to the lowest blank is stopped at a front end stop, and the lowest blank to be separated out is conveyed further through an opening to a downstream-arranged machine. The separating of the blanks thus occurs in a two-phase process which is intended to improve the operational safety. Prior to the return movement of the advancing element, however, this element along with the transporters must again be lowered to its starting position. In the process, the feed element realizes a large stroke in pushing direction, as well as at a right angle thereto, which requires comparatively expensive mechanical elements and has a negative effect on the production costs and the service life, as well as the achievable output rate.

The German patent document DE 19756374A1 discloses an apparatus for separating out book covers from a stack, said apparatus consisting of a back and forth moving suction conveying element and a pair of intake rollers arranged downstream in transporting direction. For an operationally safe separating out of the book covers, it is proposed that the suction conveying element be raised slightly above the stacking table during the operating stroke and that it be lowered slightly below the stacking table during the return stroke. As soon as the front of the lowest book cover reaches the intake rollers, the upper roller which is not driven is lowered with the aid of working cylinders toward the lower, driven roller while the suction conveying element changes to its return stroke. Even though the use of the intake roller pair permits a secure conveying out of the separated out book covers, the speed conditions are unfavorable during the transfer of the separated book covers from the suction conveying element to the intake roller pair. Whereas the driven intake roller has a constant, high peripheral speed that is matched to the following conveyor, the suction conveying element near its turning point has long since moved past the maximum stroke speed.

During a renewed acceleration of the separated book cover in the intake roller pair, this results in abrasion and wear along the surface of the book cover which can result in a reduction in quality. Since only the lower roller of the intake roller pair is driven, a deformation as well as a slanted movement of the book covers should furthermore be expected which can lead to problems in the downstream-arranged units. Finally, the separating out capacity is also limited with this solution because of the fact that the upper intake roller is lowered onto the lower intake roller when the book cover arrives.

The European patent document EP 0384979B1 discloses an apparatus for separating out stacked book blocks, said apparatus having an endlessly circulating conveying line that is equipped with ejection elements as an alternative to a back and forth moving push table. While this apparatus causes hardly any vibrations, owing to the continuous movement of the conveying line, a quick interruption of the separating operation is not possible because of the ejection elements which are arranged at fixed distances to each other, thereby resulting in a disadvantage for the feeding of downstream-arranged apparatuses.

The German patent document DE 10223350A1 discloses an apparatus for separating printed sheets from a stack which apparatus essentially comprises support bars, a delivery device provided with pushing elements and a removal device provided with a pair of withdrawing rollers. The pushing elements in this case are driven by a linear motor that is assigned directly to the pushing device. As a result, the movement profile of the pushing device can be varied in dependence on the required removal speed. In addition, the linear motor offers the option for a direct adaptation of the pushing stroke to the format size of the printed sheet, thus reducing the number of necessary format changeovers. The apparatus can be operated such that the printed sheets are conveyed out either with a constant, pre-defined division or format-dependent with defined gaps between the printed sheets. The lowest printed sheet is accelerated with the aid of the pushing elements to the ejection speed and is then conveyed out with a constant speed by the downstream arranged pair of withdrawing rollers.

While this solution permits an extremely flexible separating out of printed sheets, the high costs and the high heat that is generated in the linear motor present a disadvantage. Since the primary part of the linear motor moves along with the pushing element, the motor must be fed via a drag chain which is problematic for a continuous operation with high accelerations. The relatively large mass to be accelerated furthermore results in high forces which must be absorbed by the frame for the apparatus. Depending on the separation rate, this can lead to high vibrations. The withdrawing roller pair with a fixed adjustment, relative to each other, is furthermore not suitable for processing adhesive-bound catalogs with a bulky back. Finally, there is the danger of the remaining stack tilting to one side during the separating out of the lowest printed sheet.

A problem with known approaches for a solution is that the movement sequences for the pushing process are fixedly predetermined and that the acceleration of the printed products consequently cannot be optimized for a high rate of separation. In addition, the speed conditions at the transfer points, especially during the product transfer from the push table to the removal rollers, may be unfavorable to such a degree that the quality of the printed products may suffer.

Owing to rigid movement sequences predetermined by the mechanical system, the movement may not be adapted to the respective format of the printed products to be separated out. The uncontrolled subsequent sliding of the remaining stack may lead to further problems, such as the printed products becoming wedged in the hopper chute, thus not permitting a safe separation process. Solution approaches which may permit a more flexible definition of the movement sequence between the push table and the conveying out speed may require more cost-intensive drive systems with a feed and control guidance that moves along. However, these systems may not be suitable for a continuous operation at a high production rate, for example at a rate of more than 15,000 operating cycles per hour.

SUMMARY

It is an object of the present invention to create a method and a corresponding apparatus to separate out printed products from a stack which may make it possible to avoid the aforementioned disadvantages and which may permit a high rate of separation as well as a careful handling of the printed products, while still having a simple structural design.

According to an embodiment of the invention, an apparatus is provided to separate out printed products from a stack, the apparatus comprising: a pushing device to separate out a respective printed product from the stack, the pushing device including a first rotary drive; and a downstream-arranged removal device to convey away the respective separated out printed product, the removal device including a second rotary drive separate from the first rotary drive.

According to another embodiment of the invention, there is provided a method to separate out printed products from a stack, comprising: separating printed products from a stack and transferring the printed products to a rotatably driven downstream-arranged removal device with a pushing device, rotatably driven separately from the removal device, and which accelerates the printed products to a first speed; and conveying the printed products away with the separately rotatably driven removal device to accelerate the printed products to a second speed that is greater than the first speed.

The pushing device and the removal device for the separating apparatus in this case are each provided with a separate, rotating drive unit. Both devices are therefore driven independently, wherein the printed products are accelerated in the pushing device to a first speed and in the removal device to a second, higher speed, relative to the first speed.

According to one embodiment of the invention, the pushing device is essentially arranged below a hopper which holds the stack. The pushing device includes a push table having at least one carrier attached to it and/or with at least one vacuum opening arranged in the push table. A fast-acting valve is arranged between the at least one vacuum opening and a vacuum source. With the aid of the fast-acting valve, the at least one vacuum opening is connected synchronized with the vacuum source. As a result, the underside of the lowest printed product may be suctioned forcefully against the push table, thereby ensuring in particular a secure separation for thin printed products.

The at least one vacuum opening may be separated from the vacuum source by the fast-acting valve. The operation of the vacuum opening may be synchronized with the fast-acting valve, possibly compensated by a dead time, such that the separation is shortly before when the printed product is transferred from the pushing device to the removal device. To achieve a particularly rapid drop in the vacuum, the evacuated volume may be additionally filled with compressed air. Further, the carrier may be used for the separation in place of or in addition to the vacuum openings. For this embodiment, the carrier may be adapted to the thickness of the printed products, but at a minimum should be high enough to rest form-fittingly against the printed product to be pushed away.

For this embodiment, the drive unit of the pushing device may be controlled such that the maximum speed of the push table is reached only after the halfway mark for the pushing stroke has passed. Therefore, no essential speed differences exist during the transfer of the printed product from the pushing device to the removal device. The acceleration is thus divided into two phases, thereby making it possible to achieve a more careful treatment of the printed products. The translational movement of the pushing device is realized in this case with a cost-effective and durable crossed-belt crank drive which is drive-connected to the push table. A crank loop can also serve to generate the movement.

In another embodiment, the drive for the removal device may be controlled such that its speed does not remain constant, following the takeover of the printed product from the pushing device. Rather, the speed may be changed during the course of the further removal of the printed product until the intake speed of a downstream-arranged unit of the separating apparatus is reached. For example, the speed may be increased until the intake speed of a downstream-arranged unit of the separating apparatus is reached. The printed product to be pushed out is thus accelerated during two phases until it reaches the speed required for the removal, which contributes to a careful handling of the printed product.

In addition, the movement sequence of the drive and thus the removal device may be adapted in dependence on the length of the printed products, such that a minimum acceleration acts upon the printed product to be transported. Finally, the required intake speed can be adapted easily and quickly by correspondingly changing the movement sequence for the removal device, thus making possible a quick division change, meaning a change in the distances between the printed products.

According to one embodiment of the invention, the upper removal roller of at least one roller pair that is used for conveying the previously separated printed product, is moved up and down once by one stroke during each separation cycle. Owing to the fact that in particular adhesive-bound printed products, which are conveyed in a direction transverse to the positioning of their backs, the products may be damaged by pressing rollers along the book back. The forceful intervention of the at least one roller pair be applied only a short distance after the book back.

Before the following printed product reaches the at least one roller pair, the upper removal roller is again moved upward to the starting position. The upper removal roller and thus also its lifting movement may be connected to the drive for the pushing device since both systems have the same clocked sequence. The upper removal roller may also be coupled with the drive for the removal device. To be able to activate the lifting movement independent of the further conditions, a separate drive may be provided for this function.

According to another embodiment of the invention, the at least one upper removal roller may be arranged on a shaft positioned inside a lifting carriage. The lifting carriage may move vertically up and down along a frame for the device. The lifting carriage may be provided with a cam disk that is operated by the drive shaft and includes a cam roller which rolls off along the periphery under the effect of a spring that is directly connected to the lifting carriage. The cam roller, in particular, may be provided with a drive that is separate from the drive for the pushing device and the drive for the removal device. The lifting carriage movement for the upper removal roller may be guided, e.g. with a linear guide or with recirculating linear ball bearings, such that in case of an overload the cam roller can lift off the cam disk without causing any damage.

According to another embodiment of the invention, the hold-back mechanism or holder for the removal device is provided with a sensor. The sensor may be directed toward the at least one upper removal roller and may detect the lower dead center of a lifting carriage for the upper removal roller, for example with the aid of an inductive initiator. An error has occurred if the lower dead center is never reached during a separating cycle. An error of this type can be the result of adjusting the clearance height too low, relative to the thickness of the printed product, or of a dual withdrawal (two products are removed jointly), or of an overload caused by a product jam.

According to another embodiment of the invention, the pushing device is protected against overload by comparing the actual torque course for the pushing device drive to an expected course for the torque and by stopping the drive immediately if a specified deviation is exceeded.

According to another embodiment of the invention, the crossed-belt crank drive includes a drive shaft with a thereon mounted crank disk. The crank disk has a first axis, arranged eccentric to the drive shaft, and is connected in this first axis with a first end of a connecting rod, to allow rotation. A second end of the connecting rod is connected, to allow rotation, with the aid of a second axis to a first holder that is secured on the push table. Second holders which respectively hold one ball box are arranged on the push table. At least two guide rods may be arranged parallel to each other in removal direction for the printed products. The at least two guide rods are mounted on a frame of the device are used as guides for the ball boxes.

In another embodiment of the invention, a removal device is arranged downstream of the hopper. The removal device includes an upper and a lower removal roller and a hold-back mechanism or holder for the printed products located inside the hopper. A first clearance height for the printed products is formed between the hold-back mechanism and a support surface of the push table. A second clearance height for the printed products is formed between the removal rollers, wherein both clearance heights in particular are fixedly related to each other.

The hold-back mechanism in particular can be adjusted to a first clearance height and the removal roller can be adjusted to a second clearance height. The hold-back mechanism is designed to hold back the second-lowest printed product inside the hopper while the lowest printed product is conveyed away by the push table in a discharge direction. If the first clearance height is adjusted too low, relative to the thickness of the printed product, a product jam can occur or the printed products can be damaged. If the first clearance height is adjusted too high, the second-lowest printed product can be conveyed along with the lowest printed product. The aforementioned fixed relationship between the first clearance height and the second clearance height may be, for example at a ratio of approximately 1.1 to 1.9.

According to an embodiment of the invention, the fixed connection may be achieved by using two separate threaded spindles which act upon the hold-back mechanism and/or the upper removal roller and thus upon the first and/or the second clearance height. Accordingly, the thread pitches of the spindles may be embodied differently or they are provided with different drive wheels and thus have different speeds. This direct connection simplifies the adjustment during the set-up because no separate re-adjustment is required, thus resulting in a time saving. The adjustment in this case may either be made manually or with the aid of an adjustment drive.

When using a separate servomotor, the first clearance height may be changed dynamically during a pushing-out movement. For example, the clearance height may compensate for differences in the product thickness over the length of the product which may be caused by a goods sample. In this way, printed products with varying thicknesses may also be separated without resulting in markings on the products. Of course, not only the first but also the second clearance height or both clearance heights jointly may be changed during the removal of the printed products in accordance with the thickness of the respective printed products.

According to another embodiment of the invention, the return stroke of the push table may be configured such that at the same time as the back of the lowest printed product passes below the hold-back device, the carrier on the push table moves with its stop face past the back of the second-lowest printed product. Thus, a controllable subsequent sliding of the residual stack may occur. In the process, the printed products drop parallel to the support surface onto the push table which may be important when processing thick printed products. If a one-sided subsequent sliding occurs with thick products of the thick type, the stacking movement may become very irregular and may result in the danger that the printed products will tilt inside the hopper and obstruct the separating operation.

Yet another embodiment of the invention relates to suppressing the separating operation during one or several working cycles, without reducing the speed of the pushing device and/or the removal device. With the aid of the above-described apparatus, the separating operation may be adapted, if need be, to ensure that no product is separated during at least one operating cycle. The drive for the pushing device may realize a return stroke movement following the transfer of a printed product to be separated while the movement of the at least one roller pair continues along its normal course. The return-stroke movement may involve a holding position in an intermediate location from which it is possible to return to the normal separating operation if necessary.

Having separate drives for the pushing device and the removal device may make it possible to uncouple the starting movements and stopping movements of the two systems. The operation of the pushing device can thus also be suppressed, for example, over two or more operating cycles. With respect to time, however, a critical suppression may be over a single operating cycle.

According to a further modification of the invention, the control unit may be supplied with information relating to the dimensions of the printed products to be separated, for example, the length and thickness of the products. The control unit may use either an operator's control unit or a different data transmission method. Following this step, the relevant axes may be adjusted with the aid of servomotors to the required dimensions and/or a direct influence may be exerted onto the configuration of the movement profiles for the push table and/or the removal rollers. The respective input can be made by an operator, with the aid of a master control or through scanning at the hopper itself with a sensor arrangement. The dimensions of the printed products may be detected via sensors which are mounted directly in the hopper for the separating apparatus.

BRIEF DESCRIPTION OF THE DRAWINGS

These and other features of the invention will be further understood from the following detailed description of the embodiments with reference to the accompanying drawings which show in.

DETAILED DESCRIPTION

Figure 1:
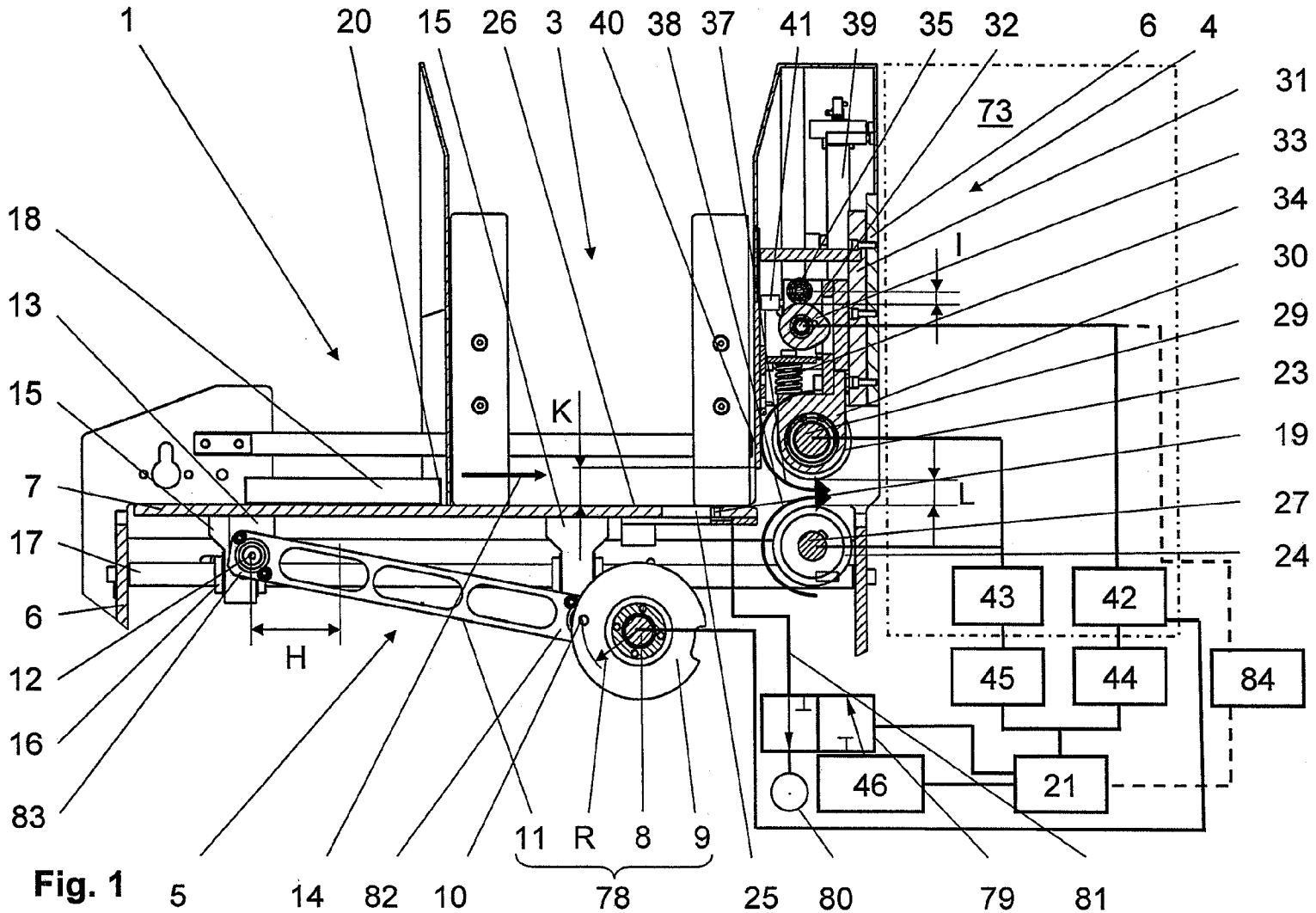
FIG. 1 is a view from the side of a separating apparatus according to an embodiment of the invention, shown as a section through the center plane.

FIG. 1 shows a separating apparatus 1 for printed products 2, 2*a*, 2*b*, 2*c* (FIG. 3, FIGS. 6*a*-6*f*) which includes a hopper 3, a removal device 4 and a pushing device 5 that are respectively mounted on a frame 6. The frame 6 is a welded structure comprising several individual parts, for example, but can also include several parts that are attachable such as screwed together or may be a cast-iron construction.

The pushing device 5 comprises a push table 7 as well as components required for the translational back and forth movement of the table. These components include the drive shaft 8 with thereon mounted crank disk 9. The crank disk 9 is connected in a first axis with a first end 82 of a connecting rod 11 and rotates. An opposite-arranged, second end 83 of the connecting rod 11 is connected rotating with the aid of a second axis 12 to a holder 13. The holder 13 is secured to the push table 7.

To generate a translational back and forth movement of the push table 7 in a removal direction 14, the push table 7 is connected to second holders 15. The second holders 15 are provided with ball boxes 16. The ball boxes 16 are guided by at least two guide rods 17. The two guide rods 17 are arranged parallel to each other in removal direction 14 and are attached to the frame 6. A stroke H of the push table 7 in this case may be determined by a crank radius R of the crank disk 9. A robust and wear-resistant pushing device 5 may be realized easily and cost-effectively with the aid of a crossed-belt crank drive 78.

The crank drive 78 includes a drive shaft 8, a crank disk 9 and the connecting rod 11. The drive shaft 8 is arranged offset relative to the orientation of the guide rod 17. A back and forth moving counter mass to the push table 7 may be installed in order to balance out the mass and thus reduce the vibrations on the frame 6. A slider crank can furthermore be used as alternative to the crossed-belt crank drive 78.

A carrier 18 is arranged on the push table 7 and/or vacuum openings 19 are arranged in the push table 7 for conveying the lowest printed product 2*a* to be separated from the stack (FIGS. 6*a*-*f*). The carrier 18 is attached in dependence on a length A (FIG. 3) of the printed products 2, 2*a*, 2*b*, 2*c* in the respective position on the push table 7. A stop face 20 on the front of the carrier 18 in this case functions to carry the lowest printed product 2*a* along in a form-fitting manner.

To improve the processing safety during the separating of the printed products 2, 2*a*, 2*b*, 2*c*, the vertical dimensions of the carrier 18 may be adapted to a thickness C of the printed products 2, 2*a*, 2*b*, 2*c*. Differently tall carriers 18 may be used for the adaptation. The vacuum openings 19 represent a different option for carrying along the separated printed product 2, 2*a*, 2*b*, 2*c* by the push table 7. The vacuum openings 19 may be arranged alternatively to or in addition to the carrier 18.

A fast-acting valve 79 may be switched by a control 21. The valve 79 may switch in such a way that starting with the beginning of the working stroke M (FIG. 5) until just before reaching a transfer point 22, a vacuum chamber 25 is evacuated by a vacuum source 80 with the aid of a feed line 81. The vacuum chamber 25 is arranged on the push table 7. At the transfer point 22, the respective printed product 2, 2*a*, 2*b*, 2*c* is transferred to a roller pair which includes respectively an upper and a lower removal roller 23, 24 of the removal device 4.

The vacuum openings 19 in the push table 7 are connected to the vacuum chamber 25. With the aid of the vacuum openings 19, the underside of the lowest printed product 2*a* is suctioned frictionally adhering against a support surface 26 of the push table 7. Of course, the vacuum can also be generated directly on the push table 7, for example using an injector (not shown) which may operate with compressed air based on the Venturi principle. If necessary, the vacuum can be neutralized relatively quickly by using additional compressed air. Alternatively, a single roller pair can also be used which comprises an upper and a lower removal roller 23, 24, wherein more than two roller pairs can also be arranged.

Figure 2:
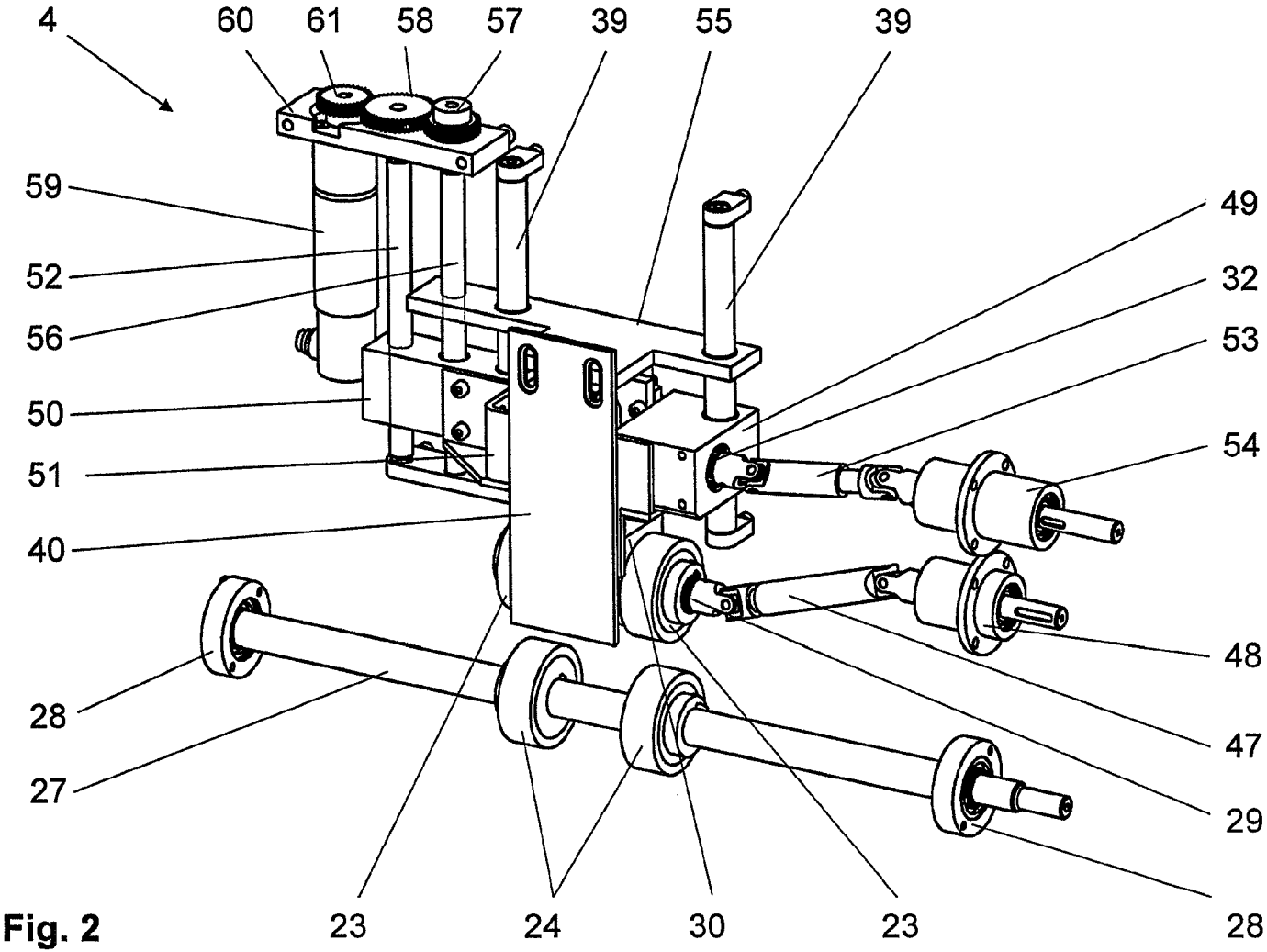
FIG. 2 is a perspective representation of a removal device.

The removal device 4 comprises a hold-back device that is attached to the frame 6, as well as the aforementioned roller pairs, wherein the lower removal rollers 24 are driven via a shaft 27 which, in turn, is mounted with bearings 28 in the frame 6, as shown in FIG. 2. The removal rollers 23, 24 are provided along the circumference with a rubber surface to achieve the required contact force, as well as the required friction between the removal rollers 23, 24 and the surface of the respective printed products 2, 2*a*, 2*b*, 2*c*. A first clearance height K for the printed products is formed between the hold-back device 40 and the support surface 26 of the push table 7.

The upper removal rollers 23 are driven by a shaft 29 which, in turn, is positioned in a lifting carriage 30. The lifting carriage 30 cooperates with a linear guide 31. The linear guide 31 is attached to the frame 6 and permits a vertical translational movement of the lifting carriage 30, meaning at a right angle to the removal direction 14. The lifting carriage 30 furthermore comprises a cam disk 33. The cam disk 33 is driven by a drive shaft 32 and is provided with a cam roller 35. The cam roller 35 rolls off along the circumference under the effect of a spring 34. The spring 34 is directly connected to the lifting carriage 30. A stroke I for the upper removal rollers 23 results from this arrangement.

The stroke I represents the amount by which a second clearance height L fluctuates between the upper removal rollers 23 and the lower removal rollers 24 during a working cycle. The drive shaft 32 carries out one rotation per separating cycle while the stroke I of the upper removal rollers 23 is approximately 4-8 mm. This is sufficient to prevent damage to the front of the respective printed product 2, 2*a*, 2*b*, 2*c* during the removal operation. The upper removal rollers 23 and the lower removal rollers 24 rotate in opposite directions during the removal operation, as shown with the directional arrows 37, 38.

The second clearance height L to the respective thickness C of the individual printed product 2, 2*a*, 2*b*, 2*c* may be adjusted in such a way that the complete configuration is displaced with the aid of a guide rod 39 and parallel to the linear guide 31. The complete configuration may comprise the upper removal rollers 23 with its shaft 29, the lifting carriage 30 and the spring 34 with thereon positioned drive shaft 32 of the cam disk 33.

The first clearance height K represents the measure between the support surface 26 of the push table 7 and non-designated lower edge of a hold-back device or holder 40. The holder 40 is mounted on the frame 6. A sensor 41 may be embodied as an inductive initiator. The sensor 41 may be attached to the hold-back device 40 and may scan the lower dead center of the upper removal rollers 23 during the lifting movement, to detect an overload, if applicable.

The drive shaft 8 for the pushing device 5 is connected to a rotary drive unit 42. Owing to the rotation of the drive shaft 8, the driving movement is transmitted to the crank disk 9. The crank disk 9 imparts movement to the connecting rod 11 and the holder 13 imparts movement to the push table 7. The drive shaft 8 for the pushing device 5 and the drive shaft 32 of the cam disk 33 execute a complete rotation during each separating cycle. The drive shaft is also connected to the drive unit 42 for the pushing device 5. Alternatively, the drive shaft 32 for the cam disk 33 can also be connected to a rotary drive unit 43 for the removal device 4. The cam disk 33, which is arranged on the lifting carriage 30, includes a drive unit 84 that is separate from the drive unit 42 for the pushing device 5. The drive unit is also separate from the drive unit 43 for the removal device 4.

The drive unit 42 for the pushing device 5 may be embodied as a servomotor and may include a position feedback. Drive units of this type are cost-effective. Owing to the crossed-belt crank drive 78, the rotational direction of the drive unit may be maintained. As compared to the linear motors disclosed in the prior art, the heat dissipation of a rotary drive unit 42 of this type is strongly reduced. The drive 42 for the pushing device 5 includes a drive controller 44 and ensures that the drive unit 42 actually moves along the predetermined movement profile. The movement profile may be a non-uniform movement profile. The drive controller 44 may be a servo-controller. The drive unit 42 can alternatively be embodied as asynchronous three-phase motor with position feedback.

The drive unit 43 of the removal device 4 serves to directly move the upper as well as the lower removal rollers 23, 24. The drive unit 43 may also be embodied as a servomotor with position feedback. Alternatively, the drive 43 can also be embodied as asynchronous three-phase motor with position feedback. The movement may be transmitted in a known manner and is accordingly not shown in further detail herein. In the same way as for the drive controller 44 of the pushing device 5, a drive controller 45 of the removal device 4 takes over controlling the pre-defined movement carried out by the upper removal rollers 23 and the lower removal rollers 24.

The drive controller 45 is aided with the rotary drive unit 43. Accordingly, the change in the conveying speed during the transport of the printed products 2, 2*a*, 2*b*, 2*c* may take place and an increase may occur in the conveying speed to the removal speed. Alternatively, no change may occur in the speed or a reduction may occur in the conveying speed.

A superimposed master control unit 21 is provided for exchanging the data required for operating the separating apparatus 1. The drive controller 44 for the pushing device 5 and the drive controller 45 for the removal device 4 may assist in the operation. Adjustments made to the separating apparatus 1 can be displayed and/or changed with the aid of an operating unit 46.

FIG. 2 shows the removal device 4 which comprises three structural components. The first structural component comprises the upper removal rollers 23 which, as previously described, are driven by the shaft 29 and are positioned in the lifting carriage 30. During each separating cycle, this component carries out a lifting and a lowering movement and is drive-connected via a cardan shaft 47. The cardan shaft 47 is positioned with one end, to allow rotation, in a bearing 48. The bearing 48 is connected to the frame 6, as shown in FIG. 1.

The second component comprises a first bearing block 49 for positioning the drive shaft 32 of the cam disk 33, a second bearing block 50, and a connector 51. This second component is guided for the translational movement by two guide rods 39 and is height-adjustable via a first threaded spindle 52. By turning the threaded spindle 52, the second clearance height L can be adjusted in dependence on the product. The drive shaft 32 is driven via a cardan shaft 53, which is positioned rotating with one end in a bearing 54. The bearing 54 is also connected to the frame 6.

The third component comprises a hold-back 40 which is connected to a support 55. The translational movement is realized with the two guide rods 39. The adjustment is made via a second threaded spindle 56. By turning the threaded spindle 56, the first clearance height K can be adjusted in dependence on the product.

To achieve a fixed ratio between the first clearance height K and the second clearance height L, the threaded spindles 56 and/or 52 can respectively be provided with a gearwheel 57 and/or 58. The first gearwheel 57 may have a lower number of teeth for the same thread pitch of the threaded spindles 56, 52. As can be seen in FIG. 2, the threaded spindles 56, 52 are operated with the aid of an adjustment drive 59. The drive 59 is positioned together with the threaded spindles 56, 52 in a third bearing block 60.

The rotary movement of a gearwheel 61 is connected to the adjustment drive 59. The gearwheel 61 is transmitted to the gearwheels 58, 57 which then respectively move the associated threaded spindle 52, 56. The adjustment drive 59 can be embodied, for example, as a motor or as a manual crank. As an alternative to a joint adjustment drive 59, the second and third structural components may be adjusted separately.

Figure 3:
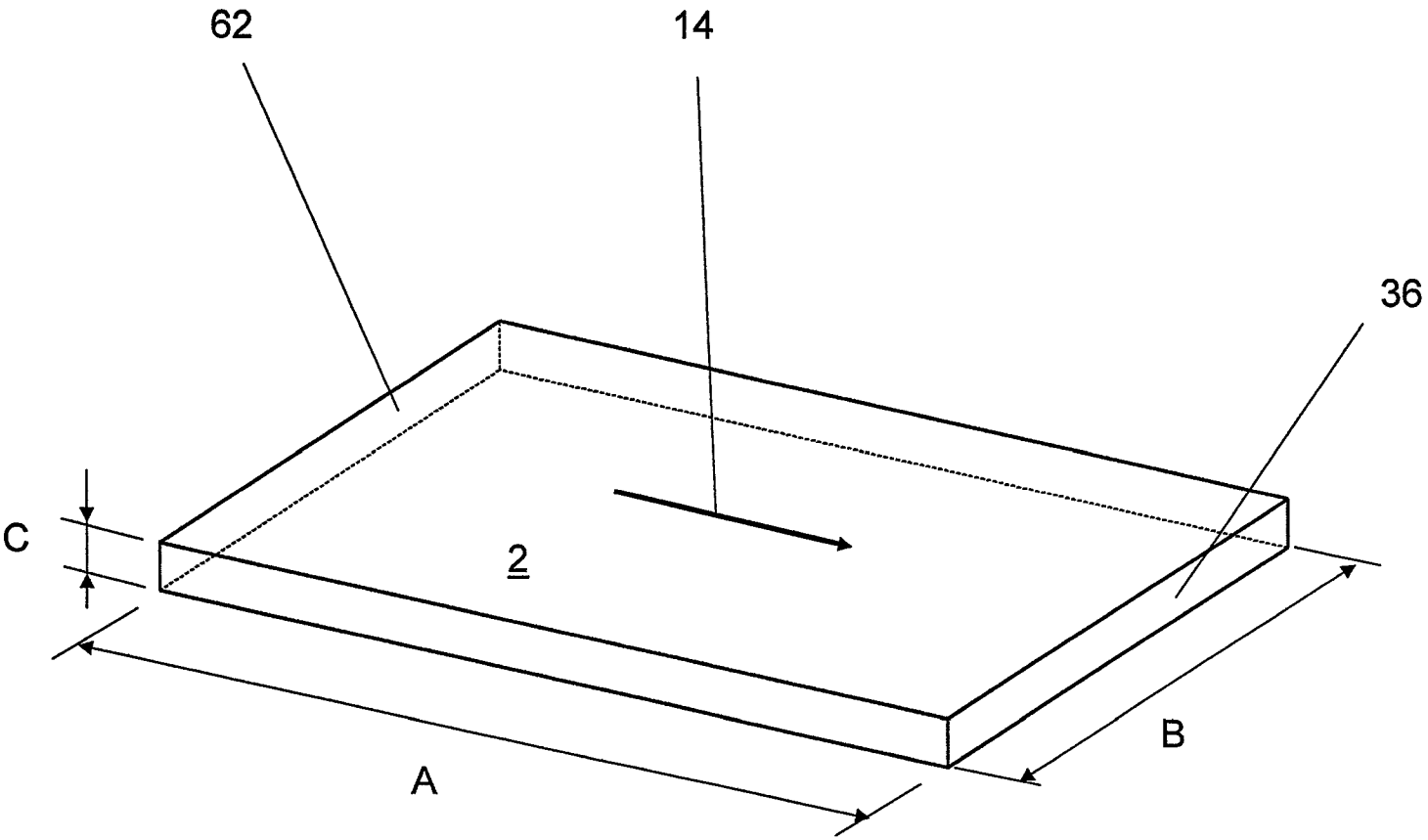
FIG. 3 is a perspective representation of printed product.

FIG. 3 shows the dimensions of a printed product 2 as seen in removal direction 14. The dimensions may include the length A, the width B and the thickness C of the printed product 2. The front of the printed product 2 is leading in removal direction 14, while a back side 62 is trailing. The printed product 2 can, for example, be a stitched magazine, a newspaper, a brochure, an adhesive-bound catalog, an insert or supplement, a thread-stitched book or a printed sheet. With this type of separation operation, the product back is frequently located on the front 36, transverse to the removal direction 14. The product back can also be arranged parallel to the removal direction 14 or can form the back side 62 of the printed product 2.

Figure 4:
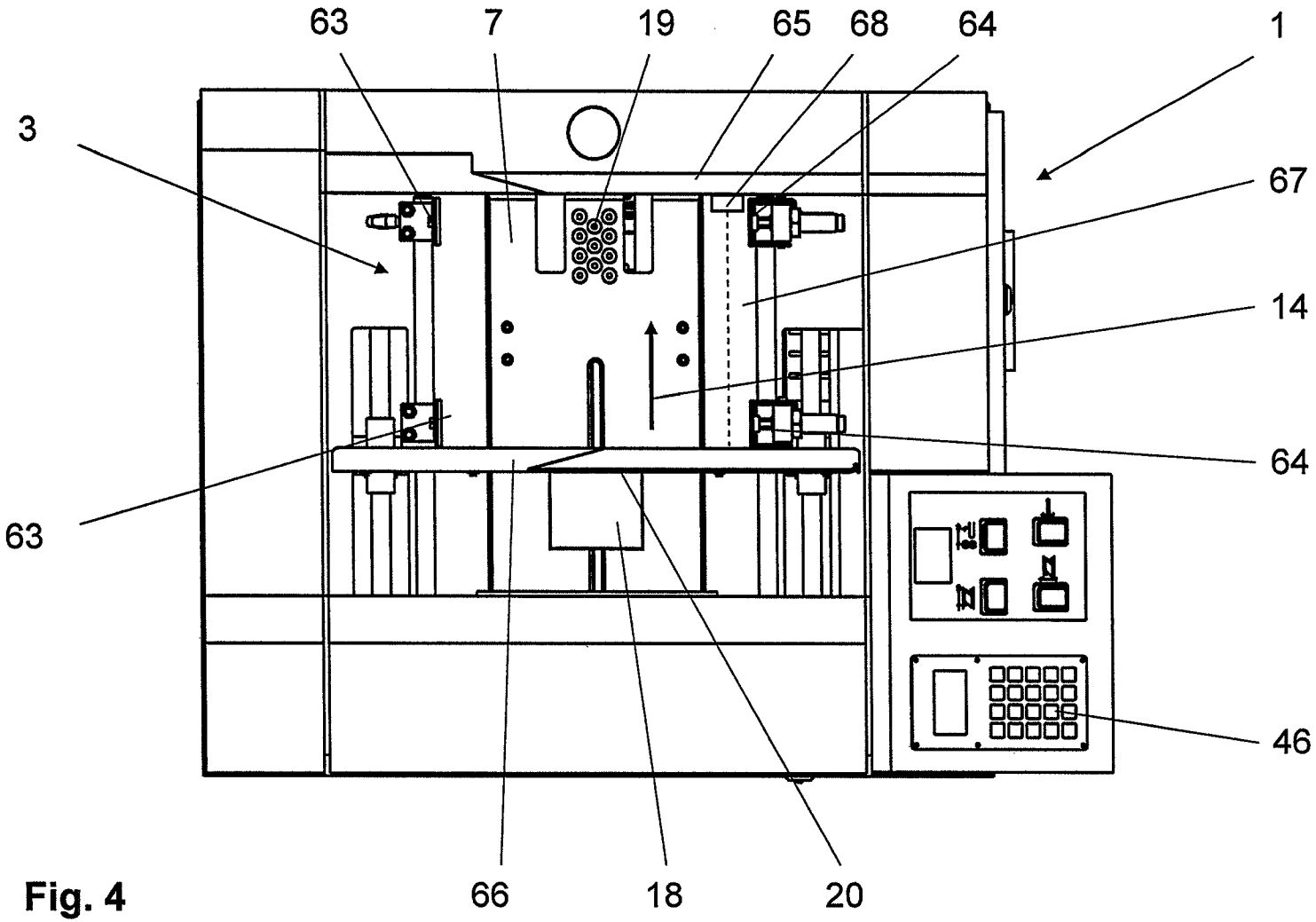
FIG. 4 is a view from above, offset by 90° relative to FIG. 1, of the separating apparatus according to an embodiment of the invention.

FIG. 4 shows a view from above the separating apparatus 1, wherein the push table 7 with the carrier and its stop face 20 are clearly visible. The hopper 3 comprises left and right end stops 63, 64 respectively as seen in removal direction 14, a front stop 65 and a back stop 66, and a hopper bottom 67. During a format change, the left side stop 63, the right side stop 64, and the back end stop 66 may be readjusted. The hopper 3 can be adjusted manually or automatically, wherein the automatic adjustment takes place with adjustment motors that are not shown herein.

Relative to the two side stops 63, 64, the vacuum openings 19 are arranged in a center region of the push table 7, downstream in removal direction 14, near the front end stop 65. A sensor 68 may be mounted on the front stop 65. The sensor 68 may be a distance sensor which functions to determine the length A of the printed product 2, 2*a*, 2*b*, 2*c*. The sensor 68 may transmit the measured value to the control unit 21. The control unit 21 then issues a command to the drive controller 44 and/or the drive controller 45 to execute a movement profile that is adapted to the length A of the printed products 2, 2*a*, 2*b*, 2*c*.

Figure 5:
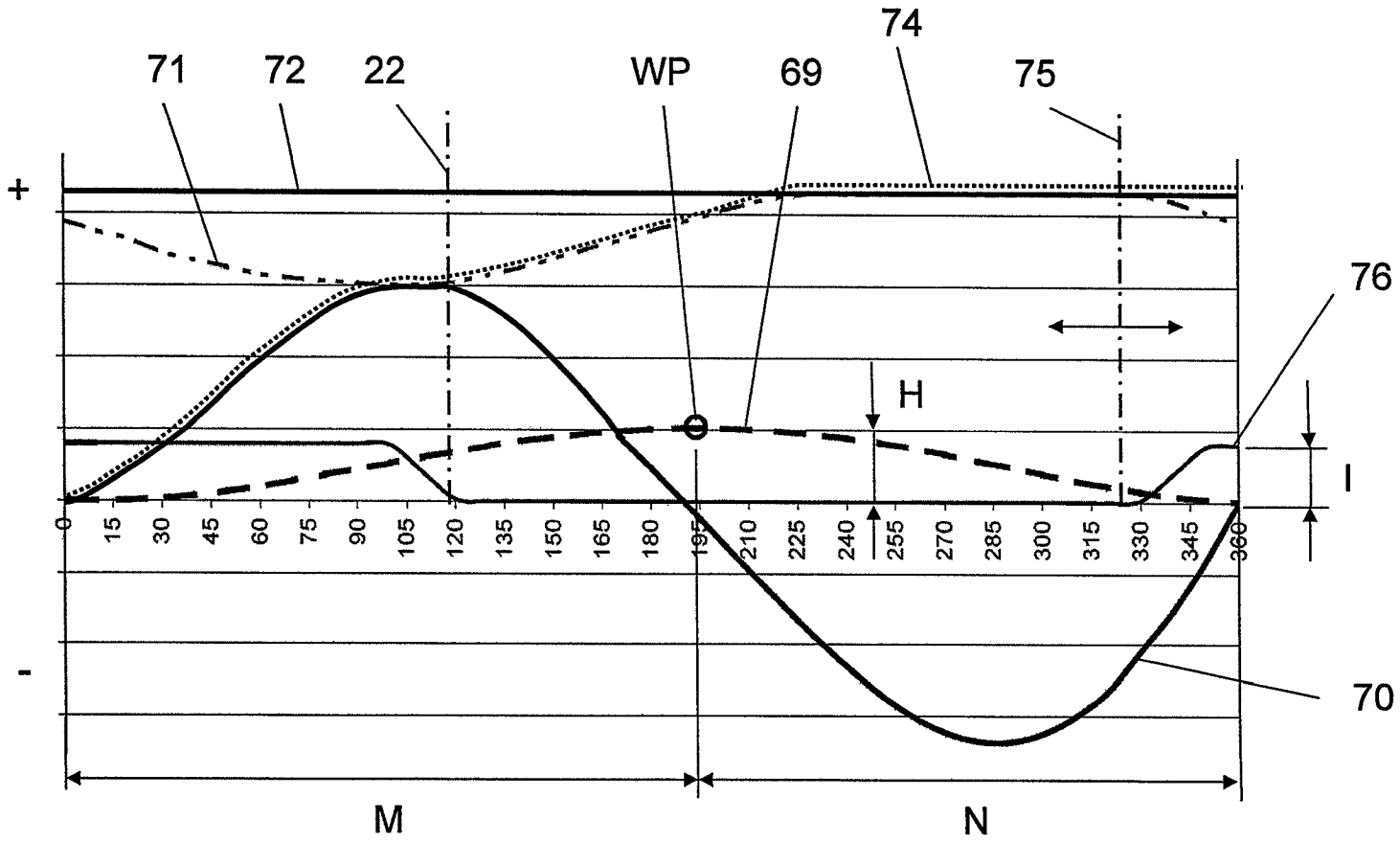
FIG. 5 is a movement diagram for a normal separating cycle.

FIG. 5 illustrates the movement diagram of an exemplary separating cycle, wherein the horizontal axis shows this cycle from 0° to 360°. On the vertical axis, the position of the push table 7 and/or its speed values are indicated, wherein the absolute values are not shown true to scale. A movement profile 69 for the push table 7 shows its lifting movement, having a turning point WP which tends to be located past the 180° point for the separating cycle. The turning point WP separates the operating stroke M from a return stroke N. A speed course that is assigned to the lifting movement of the push table 7 is illustrated with a first curve 70, showing the speed of the push table 7.

Figure 6B:
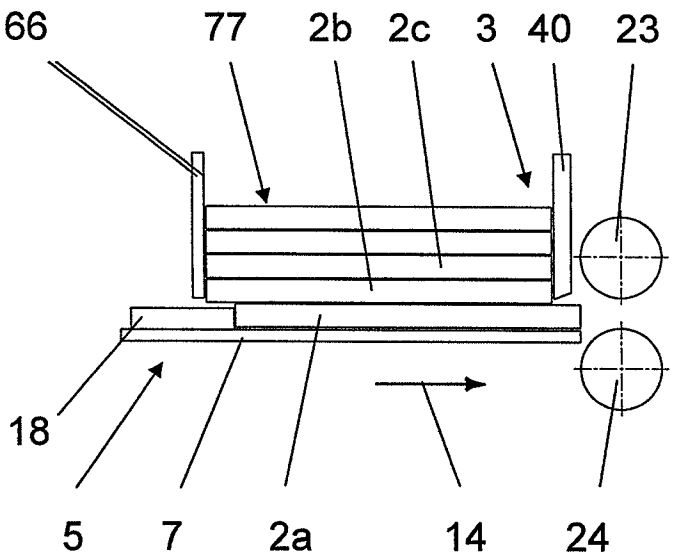
FIG. 6*b* is a schematic representation of the separating apparatus during the acceleration phase of the push table.

In contrast to a uniformly rotating, crossed-belt crank drive, the maximum speed of the push table 7 may be reached long after the halfway mark of its pushing stroke H, according to an embodiment of the invention. The circumferential speed 71 of the removal rollers 23, 24 in a first phase matches the maximum speed of the push table 7. In a second phase, the circumferential speed 71 is accelerated to match an intake speed 72, here assumed to be constant, of a downstream-arranged unit 73 of the separating apparatus 1 as indicated in FIGS. 1 and 6*f*.

A second curve 74 is designed to illustrate the speed of the printed products 2, 2*a*, 2*b*, 2*c*. The curve 74 shows that the printed product 2, 2*a*, 2*b*, 2*c* to be separated out is initially accelerated form-fittingly and/or frictionally adhering together with the push table 7, until it is gripped at the transfer point 22 by the roller pairs. The roller pairs comprise the upper and the lower removal rollers 23, 24, which move at the same speed. As a result, the printed products 2, 2*a*, 2*b*, 2*c* are accelerated further, until the required intake speed 72 for the downstream-arranged unit 73 is reached. The printed product 2, 2*a*, 2*b*, 2*c* leaves the separating apparatus at a discharge point 75 to enter the downstream-arranged unit 73.

Owing to the above-described, two-phase acceleration of the respective printed product 2, 2*a*, 2*b*, 2*c* no speed jumps may occur during its transfer from the pushing device 5 to the removal device 4. The lack of speed jumps prevents markings on the products and allows accelerating the printed product 2, 2*a*, 2*b*, 2*c* carefully to the required, changeable speed for conveying them out. A higher output rate and an improved processing safety can thus be achieved along with a more careful transport of the printed products.

The position of the transfer point 75 on the horizontal axis can therefore vary with the length A of the printed product 2, 2*a*, 2*b*, 2*c*. Shorter printed products 2, 2*a*, 2*b*, 2*c* result in a shorter intervention of the removal device 4. The shorter intervention results in a higher acceleration in the downstream-arranged units 73 with clocked sequence control and a fixed division. For shorter printed products 2, 2*a*, 2*b*, 2*c*, the transfer point 75 to the downstream-arranged unit 73 is therefore located further to the left on the horizontal axis while longer printed products 2, 2*a*, 2*b*, 2*c* can be accelerated more carefully. The acceleration phase can thus also be adapted in dependence on the format, wherein the control unit 21 triggers a corresponding change for this in the circumferential speed of the removal rollers 23, 24.

A movement profile 76 serves to illustrate the movement of the upper removal rollers 23. The upper removal rollers 23 are lowered toward the point 22 for the transfer to the roller pairs and are raised once more by the amount of the push stroke H, shortly before the end of the separating cycle. The fast-acting valve 79 activates for evacuating the vacuum openings 19.

Figure 6A:
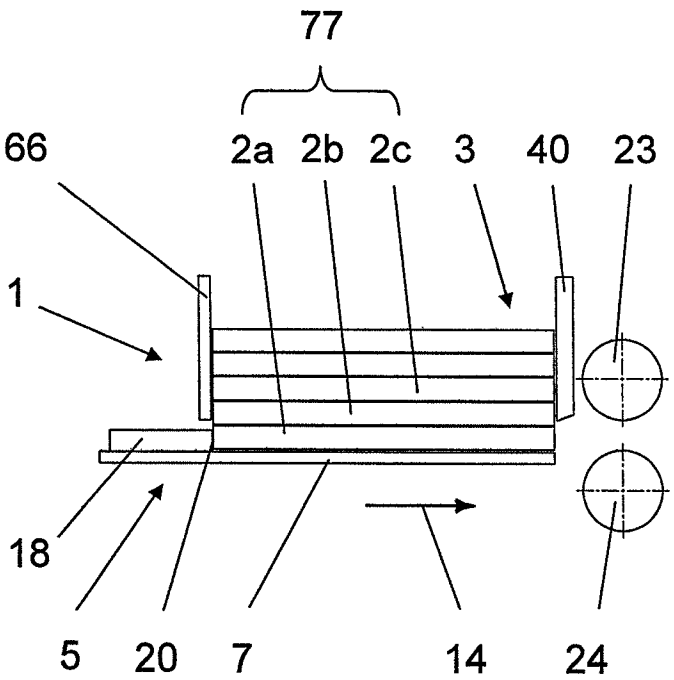
FIG. 6*a* is a schematic representation of the separating apparatus at the start of the separating cycle.
Figure 6D:
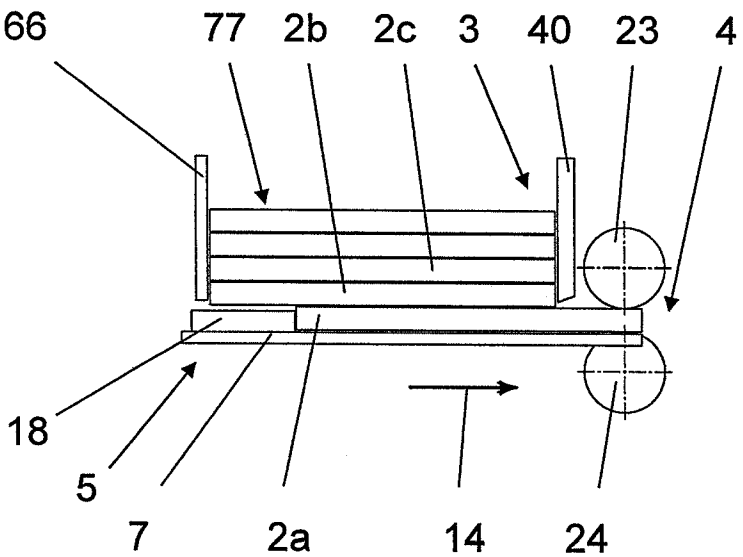
FIG. 6*d* is a schematic representation of the separating apparatus during the transfer of the printed products from the pushing device to the removal device.

FIG. 6*a* simplifies the situation at the start of a separating cycle, which corresponds to the position at 0° on the horizontal axis, as shown in FIG. 5. The lowest printed product 2*a* to be separated is still in the same position as the second lowest printed product 2*b*. The following printed product 2*c* of a stack 77 is also still in the same position while the upper removal rollers 23 are still in the raised position.

FIG. 6*b* shows the lowest printed product 2*a* to be separated out from the stack 77. The separation in FIG. 6*b* is during the acceleration phase to the maximum speed of the push table 7, resulting from the intervention of its carrier 18. All other printed products in the stack 77, including the second lowest printed product 2*b* and the following printed product 2*c*, are prevented by the hold-back device 40 from being carried along. The carrier 18 at the same time prevents a premature tilting of the residual stack. The upper removal rollers 23 are still in the raised position.

Figure 6C:
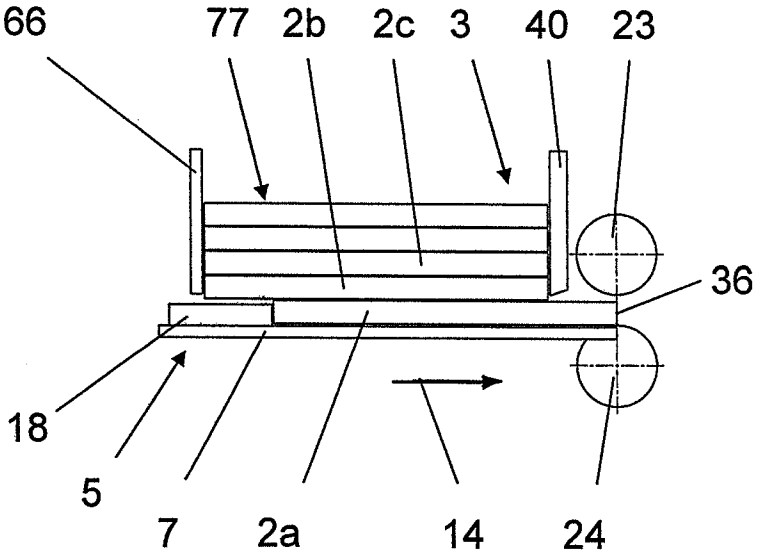
FIG. 6*c* is a schematic representation of the separating apparatus during the passage along the front of the lowest printed product, on at least one of the roller pairs used for the removal.

FIG. 6*c* indicates the point in time at which the front 36 of the lowest printed product 2*a* to be separated out reaches the plane for the upper and the lower removal rollers 23, 24. In this situation, the printed product 2*a* is still conveyed by the carrier 18 of the push table 7, and the upper removal rollers 23 have not yet made contact with the printed product 2*a*. A premature intervention of the roller pairs can result in damage or a reduction in the quality of the printed product 2*a* by damaging its front 36 which, in particular, represents an adhesive-bound book back.

FIG. 6*d* illustrates the transfer of the printed product 2*a* from the pushing device 5 to the removal device 4 at the transfer point 22 shown in FIG. 5. The upper removal rollers 23 have been lowered onto the printed product 2*a* and thus make contact. For a brief moment, the printed product 2*a* is transported by the push table 7, meaning its carrier 18, as well as the roller pairs.

Figure 6E:
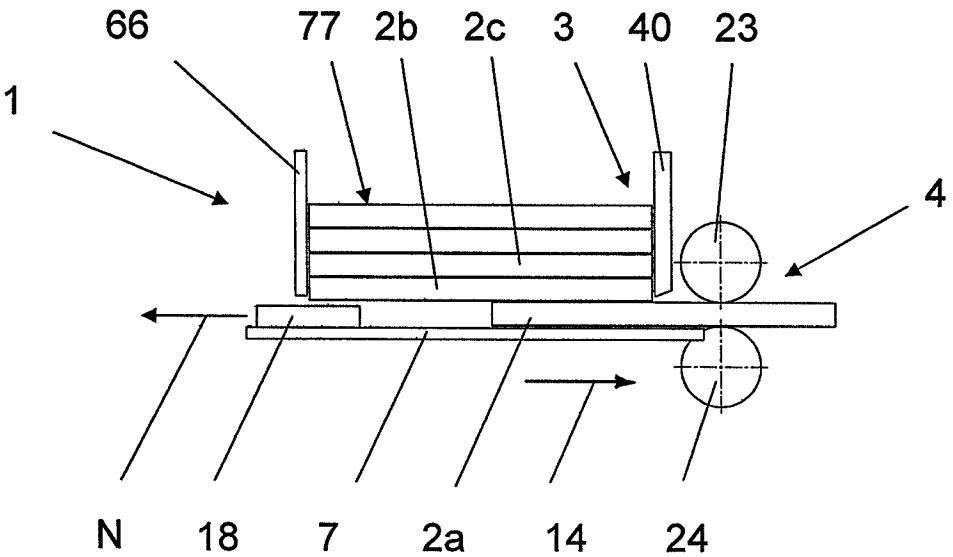
FIG. 6*e* is a schematic representation of the separating apparatus during the removal of the printed products with the removal rollers.
Figure 6F:
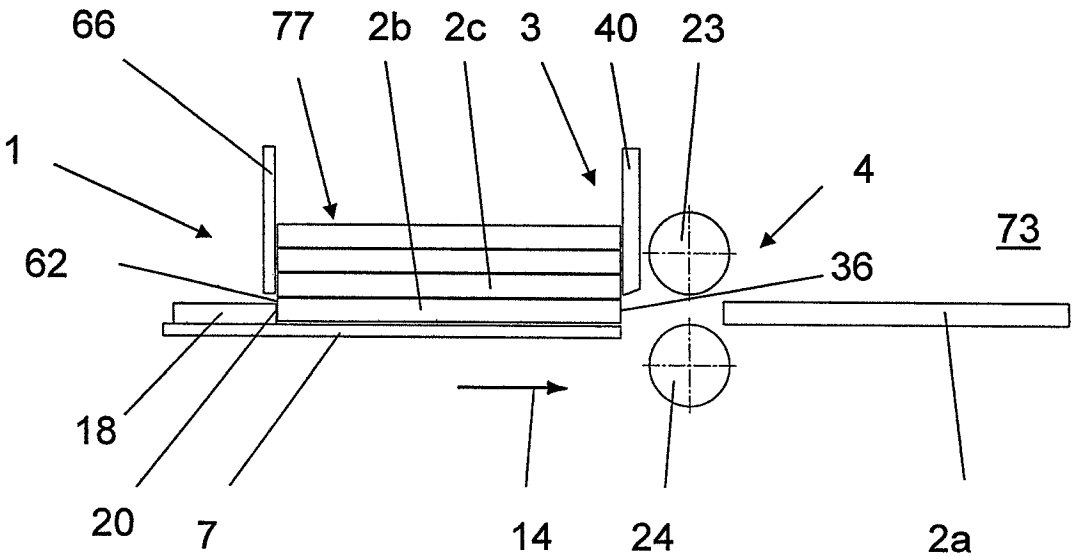
FIG. 6*f* is a schematic representation of the separating apparatus upon reaching the starting position.

FIG. 6*e* illustrates the situation in which the printed product 2*a* is conveyed out by the roller pairs while the push table 7 and its carrier 18 carry out a return stroke N.

FIG. 6*f* shows the conveyed-out printed product 2*a* which has been transferred to the downstream-arranged unit 73. The push table 7 meanwhile has again reached the starting position and is ready to separate out the previously second-lowest printed product 2*b*. At least by this point in time, the residual stack has slid down far enough, so that the underside of the printed product 2*b* comes in contact with the push table 7. The carrier 18 may release the residual stack for sliding at the same time as the printed product 2*a* leaves the hopper 3. A parallel sliding down is thus made possible and a tilting of the printed products in the residual stack may be prevented. The upper removal rollers 23 have returned once more to their raised position and the next separating cycle can start.

It will be understood that the above description of the present invention is susceptible to various modifications, changes and adaptations, and the same are intended to be comprehended within the meaning and range of equivalents of the appended claims.

What is claimed is:

1. An apparatus to separate out printed products from a stack, the apparatus comprising:

a pushing device to separate out a respective printed product from the stack, the pushing device including a first rotary drive and a push table having a support surface;

a hopper to hold the stack, wherein the pushing device is approximately arranged below the hopper; and a removal device arranged downstream of the hopper to convey away the respective separated out printed product, the removal device including:

a second rotary drive separate from the first rotary drive;

an adjustably mounted holder for the printed products inside the hopper, wherein the holder and the support surface define a first adjustable clearance height; and at least one upper removal roller and at least one lower removal roller being adjustable relative to each other, wherein the at least one upper removal roller and the at least one lower removal roller define a second adjustable clearance height for the print products, wherein the first clearance height and the second clearance height have a fixed ratio, wherein the removal device includes a first threaded spindle which acts upon the at least one upper removal roller and a second threaded spindle which acts upon the holder.

2. The apparatus according to claim 1, wherein:

the push table has at least one of (a) at least one carrier mounted on the push table and (b) at least one vacuum opening arranged in the push table.

3. The apparatus according to claim 2, wherein the push table includes at least one vacuum opening, and the apparatus further comprises:

a fast-acting valve coupled to the at least one vacuum opening and adapted to couple the at least one vacuum opening to a vacuum source.

4. The apparatus according to claim 2, further comprising a crossed-belt crank drive drive-connected to the push table.

5. The apparatus according to claim 4, further comprising:

a frame for the apparatus;

a connecting rod with a first end and a second end, wherein the crossed-belt crank drive comprises a drive shaft and a crank disk mounted on the drive shaft, the crank disc having a first axis arranged eccentric to the drive shaft, and the crank disc being rotatably connected to the first end of the connecting rod and to rotate about the first axis;

a first holder secured to the push table, wherein the second end of the connecting rod is rotatably connected to the first holder and rotates about a second axis;

a plurality of ball boxes;

second holders arranged on the push table to hold respectively one ball box; and at least two guide rods attached to the frame and connected to guide the ball boxes, wherein the at least two guide rods are arranged parallel to each other and are oriented in a removal direction for the printed products.

6. The apparatus according to claim 1, wherein a ratio between the first clearance height and the second clearance height is 1.1 to 1.9.

7. The apparatus according to claim 1, wherein the first and second threaded spindles respectively have at least one of a different thread pitch or different gearwheels.

8. The apparatus according to claim 1, wherein the at least one upper removal roller is connected to the first rotary drive or to the second rotary drive.

9. The apparatus according to claim 1, further comprising a sensor attached to the holder, the sensor comprising an inductive initiator directed toward the at least one upper removal roller.

10. The apparatus according to claim 9, wherein the sensor scans a lower dead center of the at least one upper removal roller during a stroke movement.

11. An apparatus to separate out printed products from a stack, the apparatus comprising:

a pushing device to separate out a respective printed product from the stack, the pushing device including a first rotary drive and a push table having a support surface;

a hopper to hold the stack, wherein the pushing device is approximately below the hopper; and a removal device arranged downstream of the hopper to convey away the respective separated out printed product, the removal device including;

a second rotary drive separate from the first rotary drive;

an adjustably mounted holder for the printed products inside the hopper, wherein the holder and the support surface define a first adjustable clearance height, and at least one upper removal roller and at least one lower removal roller being adjustable relative to each other, wherein that at least one upper removal roller and the at least one lower removal roller define a second adjustable clearance height for the print products, wherein the first clearance height and th second clearance height have a fixed ratio;

a frame; and a lifting carriage arranged to move vertically up and down along the frame, the lifting carriage including:

a carriage shaft, wherein the at least one upper removal roller is arranged on the carriage shaft, a cam drive shaft, a cam disk driveably connected to the cam drive shaft, a cam roller to roll off a circumference of the cam disk under the effect of a spring coupled to the lifting carriage, and a cam drive unit coupled to drive the cam drive shaft and being separate from each of the first and second rotary drives.

12. A method to separate out printed products from a stack, comprising:

separating printed products from a stack with a pushing device driven by a first rotary drive to accelerate the printed products to a first speed and transferring the printed products with the pushing device to a downstream-arranged removal device driven by second rotary drive that is separate from the first rotary drive;

conveying the printed products away with the separately rotatably driven removal device that accelerates the printed products to a second speed greater than the first speed;

determining an actual torque curve for the first rotary drive;

comparing the actual torque curve to a predetermined torque curve; and stopping the first rotary drive if a result of the comparing exceeds a previously defined deviation from the predetermined torque curve.

13. The method according to claim 12, further comprising:

controlling the pushing device and the removal device so that no substantial speed changes occur during the transferring of the printed products from the pushing device to the removal device.

14. The method according to claim 12, further comprising:

controlling the pushing device to reach a maximum speed after passing a halfway mark of a transfer stroke of the pushing device.

15. The method according to claim 12, wherein the separating is suppressed over at least one operating cycle, without lowering at least one of the first speed or the second speed.

16. The method according to claim 12, wherein the pushing device comprises at least one vacuum opening and a fast-acting valve that cooperates with the vacuum opening, wherein the method further includes controlling the fast-acting valve to separate the vacuum opening from a vacuum source with precise timing before the printed product is transferred by the pushing device to the removal device.

17. The method according to claim 12, further comprising changing the second speed during a course of transporting the printed product by controlling the removal device until an intake speed of a downstream-arranged unit is reached.

18. The method according to claim 17, further comprising changing the intake speed for the downstream-arranged unit variably.

19. The method according to claim 12, further comprising:

operating the first and second rotary drives with a non-uniform rotational movement.

20. The method according to claim 12, further comprising:

executing a return stroke movement of the pushing device after a respective printed product is transferred to the removal device.

21. The method according to claim 20, wherein the executing the return stroke movement includes: keeping the pushing device in a waiting position, at an intermediate location, from which the pushing device is movable back again to a position for separating.

22. The method according to claim 12, wherein the pushing device comprises a push table with a carrier having a stop face and the removal device comprises a holder to hold back the printed products in the stack, wherein the method further comprises:

moving a back side of a respective leading printed product below the holder at the same time as moving the stop face of the carrier past a back side of a respective following printed product.

23. The method according to claim 22, wherein the removal device comprises at least one roller pair including an upper roller and a lower roller, wherein the holder and a support surface of the push table define a first clearance height for the printed products and the upper and lower rollers define a second clearance height for the printed products; wherein the method further includes:

changing at least one of the first clearance height and the second clearance height during conveying the printed products away.

24. A method to separate out printed products from a stack, comprising:

separating printed products from a stack with a pushing device driven by a first rotary drive to accelerate the printed products to a first speed and transferring the printed products with the pushing device to a downstream-arranged removal device driven by second rotary drive that is separate from the first rotary drive, wherein the removal device comprises at least one roller pair including an upper roller and a lower roller, the upper roller being arranged on a shaft positioned in a lifting carriage movable vertically up and down along a frame, the lifting carriage including a cam disk driven by a drive-shaft having a cam roller that rolls off along a circumference of the cam disk under the effect of a spring directly connected to the lifting carriage;

conveying the printed products away with the separately rotatably driven removal device that accelerates the printed products to a second speed greater than the first speed;

moving the upper removal roller up and down by one stroke once during each separating cycle; and driving the cam disk separately from the pushing device and the removal device.

25. The method according to claim 24, further comprising:

moving the upper removal roller in a first direction to a starting position before a printed product which follows a previously separated out printed product reaches the upper and lower removal rollers.

26. A method to separate out printed products from a stack, comprising:

separating printed products from a stack with a pushing device driven by a first rotary drive to accelerate the printed products to a first speed and transferring the printed products with the pushing device to a downstream-arranged removal device driven by a second rotary drive that is separate from the first rotary drive, wherein the removal device comprises a holder to hold back the printed products in the stack and at least one roller pair including an upper roller and a lower roller;

conveying the printed products away with the separately rotatably driven removal device that accelerates the printed products to a second speed greater than the first speed;

moving the upper removal roller up and down by one stroke once during each separating cycle, wherein the removal device includes a first threaded spindle which acts upon the at least one upper removal roller and a second threaded spindle which acts upon the holder; wherein the method further includes:

transmitting information on dimensions of the printed products to be separated out to the pushing device and the removal device; and at least one of (a) adjusting adjustment axes for the first and second threaded spindles with a servo-drive and (b) influencing a configuration of movement profiles for the pushing device and the removal device.

27. The method according to claim 26, further comprising:

adapting a circumferential speed for the upper and lower removal rollers in dependence on a length of the printed products.

28. The method according to claim 26, further comprising:

accelerating a circumferential speed of the upper and lower removal rollers during a first phase to a maximum speed of the push table; and matching an intake speed for a downstream-arranged unit during a second phase.

* * * * *

UNITED STATES PATENT AND TRADEMARK OFFICE

CERTIFICATE OF CORRECTION

PATENT NO. : 8,690,151 B2
APPLICATION NO. : 12/970300
DATED : April 8, 2014
INVENTOR(S) : Gysin et al.

It is certified that error appears in the above-identified patent and that said Letters Patent is hereby corrected as shown below:

Title Page, (73) Assignee:

~~Muller Martini Holding AG~~ should be Mueller Martini Holding AG.

Signed and Sealed this
Second Day of September, 2014

Michelle K. Lee

Michelle K. Lee
*Deputy Director of the United States Patent and Trademark Office*